US006308789B1

(12) United States Patent
Kuenzi et al.

(10) Patent No.: US 6,308,789 B1
(45) Date of Patent: Oct. 30, 2001

(54) DRILL BIT FOR DIRECTIONAL DRILLING

(76) Inventors: Neal A. Kuenzi, 4001 Abbey La., NE.; Rodney R. Kuenzi, 5183 Madrona Hts. Dr., NE., both of Silverton, OR (US) 97381

( * ) Notice: Subject to any disclaimer, the term of this patent is extended or adjusted under 35 U.S.C. 154(b) by 0 days.

(21) Appl. No.: 09/427,534

(22) Filed: Oct. 26, 1999

(51) Int. Cl.[7] ..... E21B 7/08

(52) U.S. Cl. ..... 175/61; 175/75; 175/376; 175/399

(58) Field of Search ..... 175/61, 73, 75, 175/376, 398–400

(56) References Cited

U.S. PATENT DOCUMENTS 3,633,686 * 1/1972 Bennett ..... 175/4.5
4,832,143 * 5/1989 Kaalstad et al. ..... 175/365
4,848,486 * 7/1989 Bodine ..... 175/55
4,936,398 * 6/1990 Auty et al. ..... 175/336
5,778,991 * 7/1998 Ranquist et al. ..... 175/61
6,119,797 * 9/2000 Hong et al. ..... 175/336

* cited by examiner

*Primary Examiner*—William Neuder
*Assistant Examiner*—Zakiya Walker
(74) *Attorney, Agent, or Firm*—Robert L. Harrington

(57) ABSTRACT

A drill bit that is arranged to change the direction of drilling. A cone head is rotatably mounted on a shank portion extending from an elongate housing. When the housing is rotated, the cone head generates a concave hole. When a change in direction is required, the housing is rotated a few degrees in one direction and then counter-rotated in the opposite direction. This generates a partial but redirected pilot hole that is also substantially concave in configuration. Continued full rotation causes the drill bit to follow the partial pilot hole in the new direction.

4 Claims, 2 Drawing Sheets

DRILL BIT FOR DIRECTIONAL DRILLING

FIELD OF THE INVENTION

This invention relates to drilling and more particularly to lateral underground drilling, e.g., to provide a conduit for communication lines.

BACKGROUND OF THE INVENTION

Communication lines are commonly placed underground. As permitted, a narrow trench is dug along the intended path of the line and the line is laid in the trench and then covered. This procedure is not complex and relatively inexpensive. However, often it happens that an obstruction lays in the path and digging a trench is not permitted or is too difficult.

In such instances, the alternative is to drill a hole through the ground and under the obstruction. For example, if the lines are to be buried to a four foot depth, a partial trench is first dug to the four foot depth prior to the obstruction and a drill bit mounted on an extendable pipe is fed laterally along the desired path. The pipe is moderately flexible and, in at least one version, the pipe is turned by a powerful motor to turn the bit and thereby auger through the ground with the pipe being fed behind it. A flushing slurry is fed through the pipe and into and through to the leading end of the drill bit. Material that is loosened by the drill bit is flushed by the slurry back through the hole. The line is then pulled through the hole formed by the drill bit and pipe.

All of the above is common to the art of directional drilling. Not referred to, however, and also common to the process explained above, is the need to control the direction of drilling. The drill bit is designed so that it can be maneuvered to change direction. The drill bit itself has a digging head that is non-symmetrical, i.e., teeth are projected angularly from the axis of the drill bit on one side only. During normal drilling, the drill bit is rotated so that the digging action is symmetrically applied and the drill bit travels in a straight line. To change direction, the rotation is stopped and the drill bit is pushed through the ground. At whatever direction the teeth are projected, that is the direction that the drill bit will turn toward (up, down or to either side). When the desired new direction is achieved, the rotation of the bit is commenced to head the digging action in the new direction.

The location of the drill bit and the position of the teeth on the drill bit is monitored through the use of a known detection device. Thus, an operator may determine that the hole is headed too deep, too shallow or otherwise off line in one direction or the other. He stops the rotation of the drill bit with the teeth facing the desired direction. He then pushes the bit forward until the bit is properly directed (which may include a sequence of side to side oscillation of the drill bit) and the normal drilling action is continued.

Whereas existing drill bits work quite well in dirt, they do not work so well in rock or shale. A cone-type drill bit cutting head has been developed to improve performance in rock or shale. Rows of circularly arranged teeth are provided on a conical cutter head that is rotatably mounted about its conical axis to the end of a forwardly protruded and outwardly directed shank of the drill bit. The base portion of the cone side of the conical head carries one of the rows of teeth and with the mounting arrangement described is adjacent to the shank and extends laterally outwardly of the shank. The axis of the rotatable cone is directed inwardly and forwardly. The apex of the cone side and the teeth adjacent the apex cuts the material from the center of the hole while the teeth adjacent the base provide the laterally outermost cutting which forms the hole side.

Whereas the conical cutter is considered an improvement when directional drilling through rock and shale, it is not completely satisfactory (and sometimes unsatisfactory), and an objective of the present invention is to improve on the above-described cone-type drill bit.

BRIEF DESCRIPTION OF THE INVENTION

The present invention modifies the above-described cone-type drill bit. A shank provided on the drill bit is projected forwardly and inwardly. The base of a cone-type (conical) cutter head is rotatably secured to the shank in a manner whereby teeth near the base of the cone side of the cutter (the base portion of the cone side) cuts the material from the center of the hole and the apex of the cone side is projected laterally from the shank to cut the side wall of the hole. This difference can be viewed in the comparison of FIG. 1 (which illustrates the prior art) and FIG. 2 (which illustrates the present invention).

This modification is significant in terms of performance. Whereas the prior art drill bit head does not readily produce the desired directional change, such is readily produced by the device of the invention. The reason for the improved performance has not been verified and the following explanations are theories as to why such improvement is achieved.

FIGS. 1A and 2A, respectively, show the configuration of a hole being dug-by the prior art device and that of the present invention. When attempting to turn the drill bit, only one side of the hole is extended forwardly as indicated by dash lines 12 and 14 in FIGS. 1A and 2A, respectively. The desired change of direction is upwardly as viewed in the drawings and as indicated by the arrows. With reference to FIG. 1 and comparing it to FIG. 1A, it will be appreciated that the leading end of shank 16 will engage the upper side wall of the extended hole and resist turning of the tool in the upward direction. Applicant's shank 18 is on the opposite or bottom side of the hole and as it engages the extended portion of the hole, it urges the tool upwardly and in the direction of desired turning.

A second theory is suggested by the configuration of the hole being cut. Referring to the configuration of FIG. 2A, the center of the hole (point X) is the point of furthest extension. When full rotation of the tool is commenced, the bit will follow the path of least resistance and because the upper side is relieved, the bit will be urged upwardly.

In FIG. 1A, the center of the hole (point y) is inset from the side extensions. As the bit rotates to the bottom side of the hole, the inset center of the hole and the cam-like configuration that it produces will urge the bit back toward the bottom and directional change is resisted.

The above differences, advantages and benefits will, however, be more fully appreciated by reference to the following detailed description having reference to the accompanying drawings, referred to therein.

DESCRIPTION OF THE PREFERRED EMBODIMENT

Figure 1:
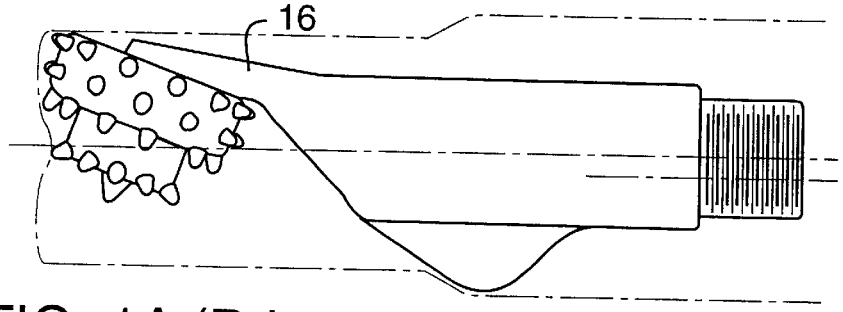
FIG. 1(Prior Art)
FIG. 1 is a side view of a tool of the prior art.
Figure 1A:
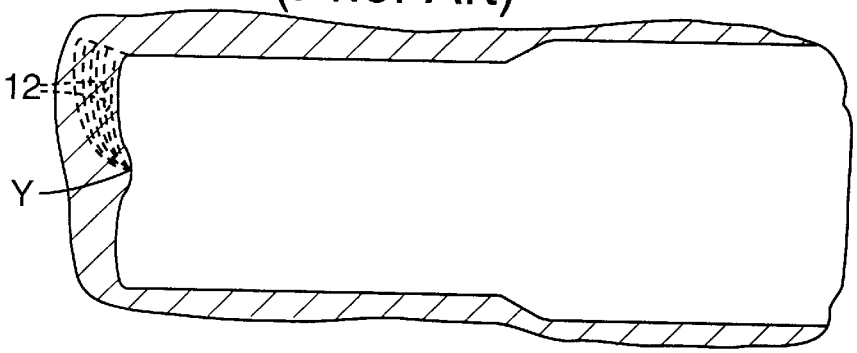
FIG. 1A (Prior Art)
FIG. 1A is a side view of a hole produced by the tool of FIG. 1.
Figure 2:
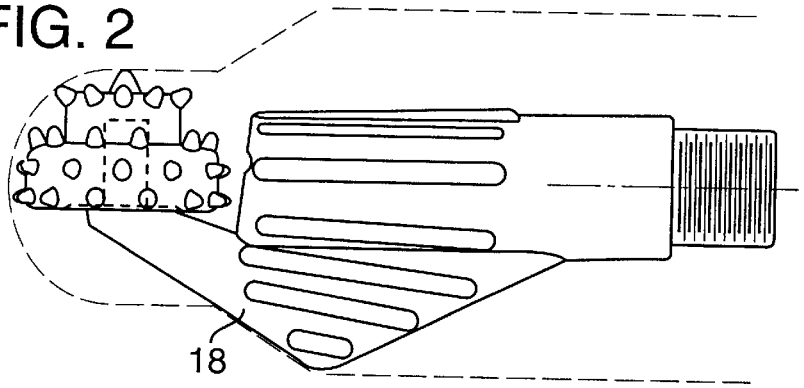
FIG. 2 is a side view of a drill bit of the present invention.
Figure 2A:
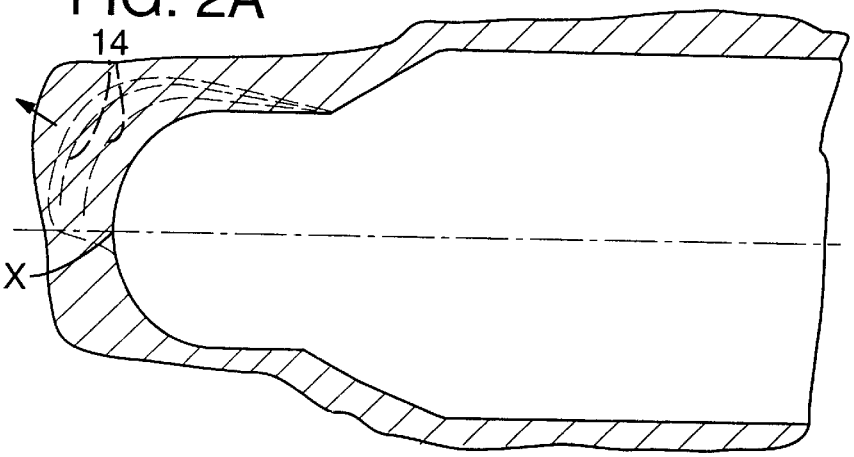
FIG. 2A is a side view of a hole produced by the tool bit of FIG. 2.
Figure 3:
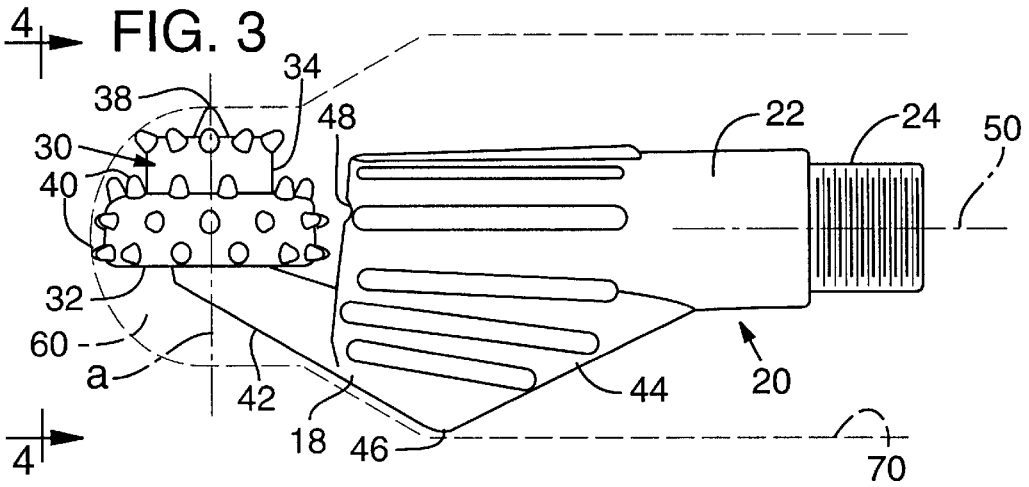
FIG. 3 is a side view of the tool of FIG. 2 illustrating also the profile of the hole produced in normal operation.

FIG. 3 illustrates a drill bit 20 for directional drilling a hole 70 (or bore) in the ground. The bit 20 has an elongate housing 22 that has a threaded end 24. The end 24 is provided to connect the housing 22 to a pipe-line 26 (see FIG. 6). A shank portion 18 is fixedly mounted to the housing at the end opposite the threaded end 24. As illustrated, the shank portion 18, which is somewhat triangular in shape extends from the housing 22 and has edges (surfaces) 42, 44 inclined at an angle to the longitudinal axis 50 of the housing 22. The peak 46, whereat the surfaces 42, 44 meet, is at a greater distance from the longitudinal center line 50 (axis) of the housing 22 than an apex portion 38 of a conical cutting head 30. The peak 46 will, however, very in height depending on the soil conditions. For example, when drilling rock, the peak 46 may have the same height as apex 38 (or it will quickly wear down to that height).

The conical cutting head 30 is rotatably mounted to the shank portion 18 about an axis a. The conical head 30 has a base side 32 and a cone shaped cutting side 34 including a base portion 37 and an apex 38. Multiple cutting teeth 40 are provided on the cutting side 34 with the teeth 40 being spaced at intervals on the head 30 extending from the base side to the apex 38.

Figure 6:
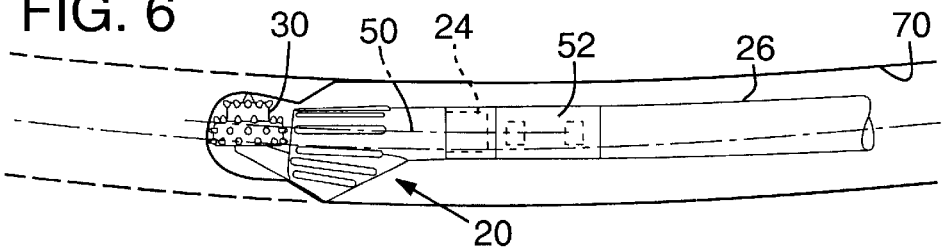
FIG. 6 is a view illustrating a typical bore produced by the drill bit of FIGS. 2–5.

The housing 22 and the pipe-line 26 as seen in FIG. 6 have a common axis of rotation 50. The housing 22 (and the pipe-line 26) are rotatably driven in either rotative direction by a known power unit (not shown). The power unit also provides forward movement and retraction of the housing 22 and the pipe-line 26. FIG. 6 illustrates the drill bit 20 boring a lateral hole 70 through the ground.

The housing 22 includes a conduit in communication with the hollow pipe for pumping a carrier such as water through the pipe-line 26 and through the housing conduit to an aperture 48. Aperture 48 is provided in the end of housing 22 in close proximity to the conical head 30. The water will carry the material cut away by the conical head 30 back through the hole 70 outside the pipe-line 26.

A known sensor mechanism 52 (FIG. 6) is provided in the pipe-line 26. The sensor mechanism 52 will provide data on the depth and location of the drill bit below the surface and will also provide the rotational orientation of the drill bit 20, particularly the rotational orientation of the conical head 30. The operator thus will have data on the depth as well as the rotational direction of the conical head 30.

With reference now to FIG. 3, a hole or bore is produced by directing the drill bit 20 through the ground in a desired direction. For example, a trench is dug and the drill bit is directed in a lateral path (parallel to the surface) at a depth of, e.g., 4–6 feet. The power unit rotates the pipe-line 26 and the drill bit 20 attached thereto. As the drill bit is rotated the power unit will apply a force to the pipe-line 26 to force the drill bit through the ground. Water is pumped through the pipe-line 26 with the water discharging from the aperture 48.

The conical head 30, as it is rotated, will remove material and generate a leading hole 60. The hole 60 is sized by the rotational path of the cone head 30. As the cone head 30 progresses, the inclined edge 42 adjacent the peak 46 will enlarge the hole as illustrated by reference 70.

When it is desired to change the directional path of the drill bit 20, the drill bit 20 is stopped as well as the forward advancement of the pipe-line 26. The sensor mechanism 52 conveys information to an above ground detector (known to the art) which provides the operator with the orientation of the cone head 30 of the drill bit 20 as well as the depth the drill bit is below the surface. The drill bit 20 is rotated, if required, until the cone head 30 is in the desired rotative position. The cone head 30 will be positioned with the apex 38 of the cone head 30 facing toward the new direction, which is upwardly as illustrated in the drawings.

Figure 4:
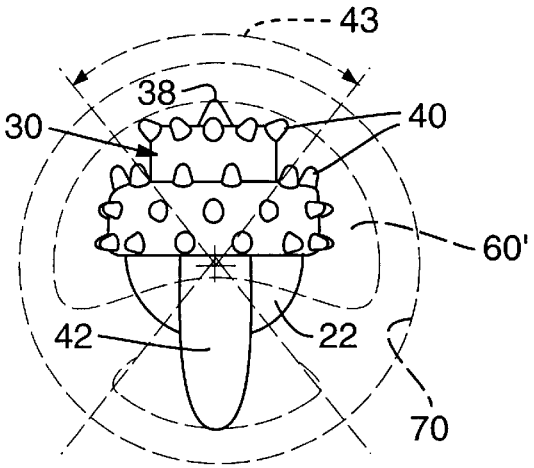
FIG. 4 is an end view as taken on view lines 4—4 of FIG. 3 illustrating a condition of partial rotation or oscillation of the drill bit.
Figure 5:
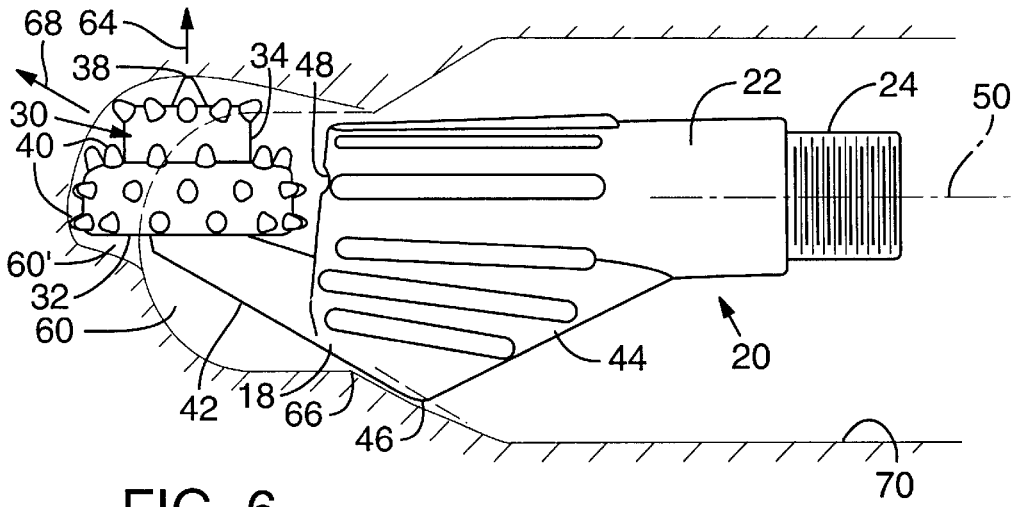
FIG. 5 is a view similar to FIG. 3 illustrating the profile of the hole produced in a directional changing operation.

The drill bit 20 is then rotated back and forth, clockwise and counter clockwise, e.g., 30° to 90° (hereafter sometimes referred to as oscillation) as the drill bit 20 is forced further through the ground. This oscillation is schematically illustrated in FIG. 4 with the degree of oscillation being indicated by arrow 43. This action will produce a partially formed leading hole 60' (see also FIG. 5). Only the upper portion of the material (as compared to hole 60) is removed to form the hole 60' as best seen in the view of FIG. 5. As the drill bit 20 is forced inwardly to form the partial hole 60', the edge 42 of shank 18 (near peak 46) will be engaging the edge 66 of the hole 60 to urge the drill bit upwardly as indicated by arrow 64. It is also believed that the leading end of edge 42 will also engage the partial hole 60' and add to the upper urging of the drill bit. After a small advancement of the oscillating drill bit, the drill bit is retracted out of the hole 60', full rotation is commenced and the drill bit is again advanced forward. The rotating drill bit is believed to center on the partial hole 60' which functions as a pilot hole to direct the drill bit in the direction 68 as depicted in FIG. 5.

It will be appreciated that the operation of changing direction of the drill bit 20 may have to be repeated more than once to accomplish the full directional change desired.

Whereas the above explanation of what produces the directional change is qualified as theoretical, the device has been built and placed in operation and the results demonstrate a significant improvement in directional drilling.

Those skilled in the art will recognize that modifications and variations may be made without departing from the true spirit and scope of the invention. The invention is therefore not to be limited to the embodiments described and illustrated but is to be determined from the appended claims.

The invention claimed is:

1. A drill bit for directional drilling comprising:

an elongated housing for connection at its rearward end to a pipeline and defining an axis of rotation extended through the housing and pipeline and about which the housing is rotated in a hole forming operation;

a shank portion extended forwardly of the housing and a conical cutting head having a base side and a cone-shaped side, said cone-shaped side having a base portion and an apex portion opposite the base portion, said conical cutting head attached to said shank portion with the base side secured to the shank portion;

said shank portion and said conical cutting head arranged at the forward end of said housing with the base portion of the cone-shaped side providing the forward most part of the drill bit along the housing axis, and the apex portion extended laterally of said axis of rotation, and cutting teeth provided at the most forward position of the base portion and at the most laterally extended position of the apex portion and cutting teeth intermediate said apex portion and said base portion for cooperative cutting of a hole as the housing is rotated about its axis.

2. A drill bit as defined in claim 1 wherein the conical cutting head is rotatably attached to the shank portion and rows of teeth are provided on said conical cutting head and positioned on the cone-shaped side for continuous replacement of the teeth engaged in the cutting of a hole as the conical cutter is rotated on the shank portion.

3. A drill bit as defined in claim 2 wherein a protrusion is provided on the housing at a side opposite the side whereat the conical cutting head portion is located, said protrusion arranged to engage a side of the hole being cut to urge the apex portion toward the opposite side.

4. A process for directional drilling comprising:

providing a drill bit having a housing rotatable around a first defined axis, a shank portion extended forwardly from the housing, a conical cutter having a circular base, an opposed apex and a convexly curved conical portion between the base and apex, said cutter rotatably mounted on the shank portion around a second defined axis and extended substantially laterally of said first axis from a center of the base to the apex, said conical cutter having cutting teeth arranged around the base of the cutter and positioned for cutting along the defined first axis as the leading cutting point in a cutting operation and further cutting teeth provided on the conical portion to cut along a concavely curved path from the leading cutting point to the conical apex at a side wall of a hole being cut;

rotating the drill bit for rotating the cutting teeth of the conical cutter around the first axis of rotation and forming thereby a concave cutting configuration defining a hole being cut;

detecting the position and direction of cutting during the cutting operation and determining therefrom a corrective direction;

positioning the apex of the conical cutter toward the corrective direction and oscillating the drill bit in a partial rotation from side to side toward said corrective direction to form an extended partial hole; and commencing full rotative turning of the drill bit.

* * * * *